US007165949B2

(12) United States Patent
Firnhaber

(10) Patent No.: US 7,165,949 B2
(45) Date of Patent: Jan. 23, 2007

(54) CAVITATION NOISE REDUCTION SYSTEM FOR A ROTARY SCREW VACUUM PUMP

(75) Inventor: Mark A. Firnhaber, LaPorte, IN (US)

(73) Assignee: Hamilton Sundstrand Corporation, Rockford, IL (US)

( * ) Notice: Subject to any disclaimer, the term of this patent is extended or adjusted under 35 U.S.C. 154(b) by 0 days.

(21) Appl. No.: 10/859,861

(22) Filed: Jun. 3, 2004

(65) Prior Publication Data

US 2005/0271537 A1 Dec. 8, 2005

(51) Int. Cl.
*F04B 39/04* (2006.01)
*F04B 39/06* (2006.01)

(52) U.S. Cl. ..... 417/228; 417/299; 417/310; 418/100; 418/201.1; 418/201.2

(58) Field of Classification Search ..... 418/100, 418/201.1, 201.2, DIG. 1, 9, 15, 97; 417/228, 417/299, 310, 440
See application file for complete search history.

(56) References Cited

U.S. PATENT DOCUMENTS 4,394,113 A 7/1983 Bammert
4,498,849 A 2/1985 Schibbye et al.
4,549,856 A * 10/1985 Cash et al. ..... 417/295
4,842,501 A 6/1989 Schibbye et al.
5,028,220 A 7/1991 Holdsworth
5,171,130 A 12/1992 Kume et al.
5,765,392 A * 6/1998 Baur ..... 418/DIG. 1

FOREIGN PATENT DOCUMENTS

DE 2948992 A * 6/1981
JP 62265489 A * 11/1987 ..... 418/15
JP 63106394 A * 5/1988
JP 01257789 A * 10/1989
JP 03151593 A * 6/1991
JP 05141383 A * 6/1993

* cited by examiner

*Primary Examiner*—Theresa Trieu
(74) *Attorney, Agent, or Firm*—Carlson, Gaskey & Olds

(57) ABSTRACT

A rotary screw vacuum pump system includes a vacuum bypass system, which communicates with a first closed cell formed by the rotor system. An air bypass valve within an air communication conduit is controlled by a solenoid valve that operates in response to a pressure switch. The pressure switch is in communication with a vacuum pump suction conduit that draws suction for a suction system attached thereto. The solenoid valve is activated by the pressure switch at a vacuum level slightly below the point at which the undesirable cavitation noise generated at terminal vacuum condition begins.

23 Claims, 5 Drawing Sheets

CAVITATION NOISE REDUCTION SYSTEM FOR A ROTARY SCREW VACUUM PUMP

BACKGROUND OF THE INVENTION

The present invention relates to a vacuum pump, and more particularly to an air bypass system therefor which injects air into a first closed rotor cell of the vacuum pump to minimize cavitation noise.

In a rotary screw oil flooded vacuum pump system, undesirable cavitation noise may be generated when operating near terminal vacuum conditions. Terminal vacuum condition is generally vacuums greater than 27" Hg at sea level (also known as deep vacuum). The cavitation noise is primary due to torque reversals, which occur in the female rotor when operating in a stated condition.

Torque reversals are a result of oil injected into the rotors and the absence of sufficient air to absorb the compression loads. At terminal vacuum conditions, there is minimal air being compressed and the rotor compression chamber fills with oil. The oil, being incompressible, causes a pressure spike, which reverses the load on the female rotor. The torque reversals are periodic in nature and occur with each rotation of each rotor lobe. The result is rotor vibration, which causes a hammering or cavitation type sound. In addition to the undesirable cavitation noise generation, operation under such conditions for an extended period of time may result in rotor damage.

Conventional vacuum pumps minimize undesirable cavitation noise generation at the terminal vacuum condition by utilization of a vacuum breaker valve to add atmospheric air to the pump intake or by a flow control valve that temporarily reduces an oil flow rate. Although effective, these arrangements may have deleterious effect on the vacuum pump system operation. The vacuum breaker valve reduces the vacuum capability of the pump to the setting of the vacuum breaker. In addition, an air filter must be used with the vacuum breaker to minimize contamination introduction into the pump. If the filter is not properly maintained, airflow may gradually decrease until the cavitation noise reoccurs. Utilization of a vacuum breaker valve also prevents operation at the terminal vacuum capability. Alternatively, reducing oil flow at deep vacuum conditions by a flow control valve increases the operating temperature of the vacuum pump. During reduced oil flow conditions, the oil cooling system provides less system cooling and the operating temperature may approach levels that are detrimental to service life.

Accordingly, it is desirable to provide a rotary screw vacuum pump system, which operates at terminal vacuum capability while minimizing undesirable cavitation noise.

SUMMARY OF THE INVENTION

The rotary screw vacuum pump system according to the present invention provides a fluid system having a vacuum bypass system. The vacuum bypass system includes a bypass air communication conduit that selectively communicates air from a reservoir to a rotor system. The rotor system includes a male rotor with helical threads that are in mesh with helical threads of a female rotor. The rotor system provides the compression capability of the vacuum pump system.

The bypass air communication conduit communicates with a first closed cell through a common or adjacent port with a rotor lubricant conduit. An air bypass valve within the air communication conduit is controlled by a solenoid valve that operates in response to a pressure switch in communication with a vacuum pump suction conduit, which draws suction for a suction system. The solenoid valve trips at a vacuum level slightly below the point at which the undesirable cavitation noise generated at terminal vacuum condition begins.

In operation, the fluid system minimizes the cavitation noise producing rotor vibration without reducing oil flow and without reducing the vacuum producing capability of the pump. At a predetermined pressure, the pressure switch activates the solenoid valve, which opens the air bypass valve. When the air bypass valve is opened, air is selectively introduced into the first closed cell from the reservoir through the air communication conduit. The addition of air from the reservoir into the first closed rotor cell does not reduce the vacuum capability of the pump system as the first closed rotor cell is part of the compression cycle and is not open to the intake. By introducing the bypass air through the bypass air communication conduit, which communicates with the first closed cell through the same or adjacent port through which the rotor lubricant conduit communicates with the first closed cell, the lubricant is better atomized, further reducing the unwanted cavitation noise by eliminating slugs of liquid oil being trapped in the compression portion of the rotors. Furthermore, the lubricant flow is not reduced and cooling of the vacuum pump system is not compromised.

The present invention therefore provides a rotary screw vacuum pump system that operates at terminal vacuum capability while minimizing undesirable cavitation noise.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
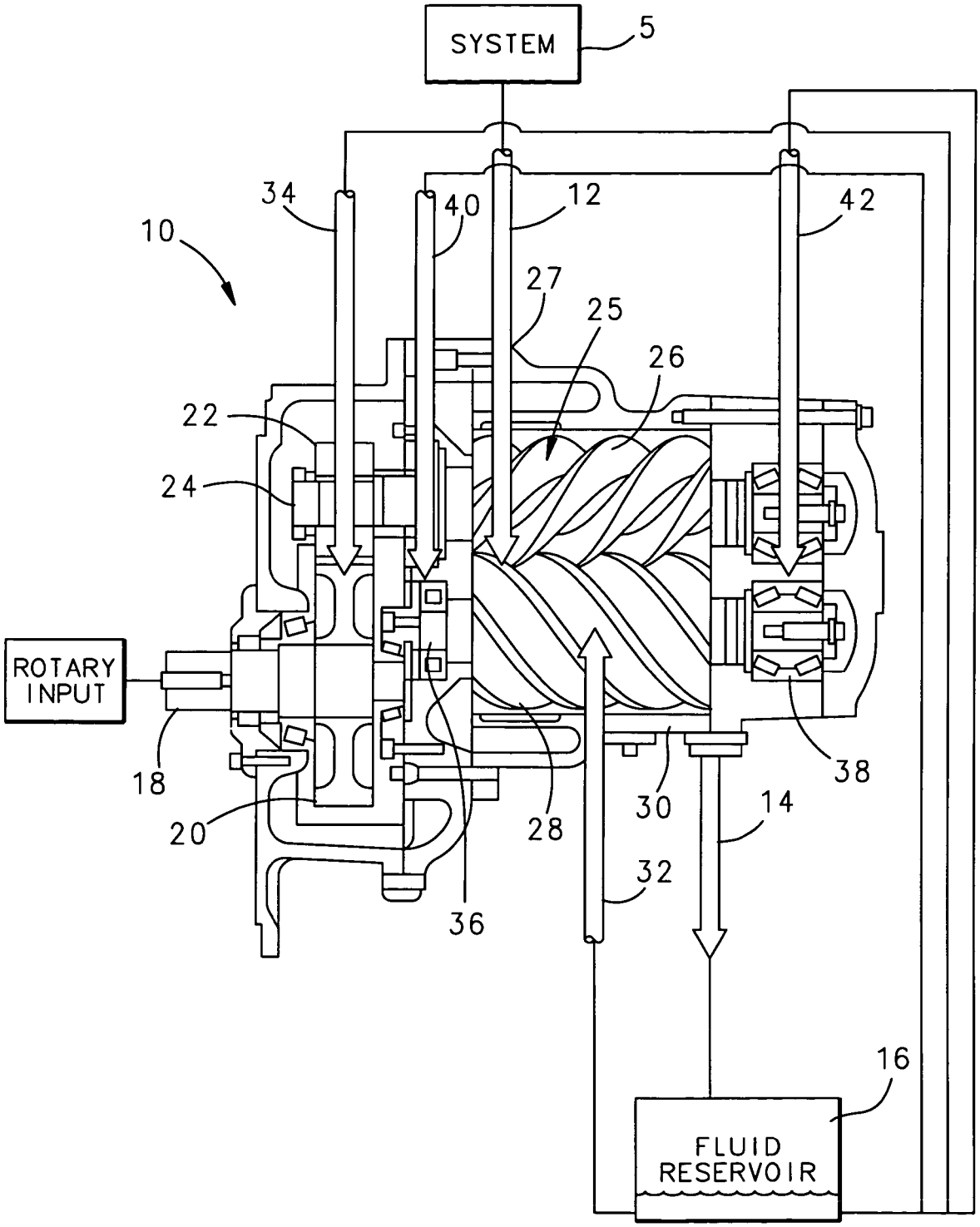
FIG. 1 is a sectional view of a rotary screw vacuum pump system.

FIG. 1 illustrates a general sectional view of a rotary screw vacuum pump system 10. The screw vacuum pump system 10 is connected to a vacuum pump suction conduit 12, which is schematically indicated by an arrow to represent the direction of travel of the process gas into the vacuum pump 10. The suction conduit 12 generates suction for a desired suction system (illustrated schematically at S). The vacuum pump system 10 also communicates with a discharge line 14 in fluid communication with a fluid reservoir 16. It should be understood that although a particular component arrangement is disclosed in the illustrated embodiment, other arrangements will benefit from the instant invention.

The vacuum pump system 10 is provided with an input shaft 18 that is connected in driving relation with a first gear 20. The first gear 20 is arranged in gear mesh relation with a second gear 22. It should be understood that the gearing arrangement is not directly related to the basic concept of the present invention and is not limiting to its scope.

The second gear 22 is associated with a shaft 24 that drives a rotor system 25. The rotor system includes a male rotor 26 with helical threads that are in mesh relation with helical threads of a female rotor 28. The rotor system 25 provides the compression capability of the vacuum pump 10.

The suction conduit 12 represents the inlet of the vacuum pump system 10 through which process gasses pass from the system S being evacuated toward an inlet port 27 of the vacuum pump 10. This suction conduit 12 is connected in fluid communication with the inlet end of the male and female rotors 26, 28. Rotation of the rotors 26, 28 compress the gas within a housing 30 as the gas is moved from left to right in FIG. 1.

A lubricant such as oil is injected into the vacuum pump system 10 at a point along the length of the rotors 26, 28 from the inlet end thereof. The lubricant is provided through a rotor lubricant conduit 32, which is in fluid communication with the reservoir 16. The lubricant is preferably injected into fluid communication with the female rotor 28 to provide cooling from the point of injection to the exhaust end of the rotors. After the gas is compressed, it is exhausted into discharge line 14.

Various other locations within the vacuum pump system 10 require lubrication to reduce friction, wear, and overheating. For example, the region in which the first and second gears 20, 22, respectively, are located requires the provision of lubricating fluid. That lubricating fluid is provided through a gear lubrication line 34 to provide lubrication for the gears 20, 22. In addition, an inlet bearing 36 and an outlet bearing 38 located at the inlet and outlet end of the rotors 26, 28 respectively also require lubrication. The lubrication is communicated to the bearing 36, 38 on lines 40, 42. Lines 32, 34, 40, and 42 communicate lubricant from the reservoir 16. It should be appreciated that lines 32, 34, 40, and 42 are illustrated schematically and need not represent either a specific relative size or a particular location of connection between the lines and the vacuum pumps 10. Instead, the lines 32, 34, 40 and 42 are schematically represented to illustrate that the vacuum pump system 10 requires lubrication and that lubrication can be provided by a plurality of appropriately located lubricant conduits.

Figure 2:
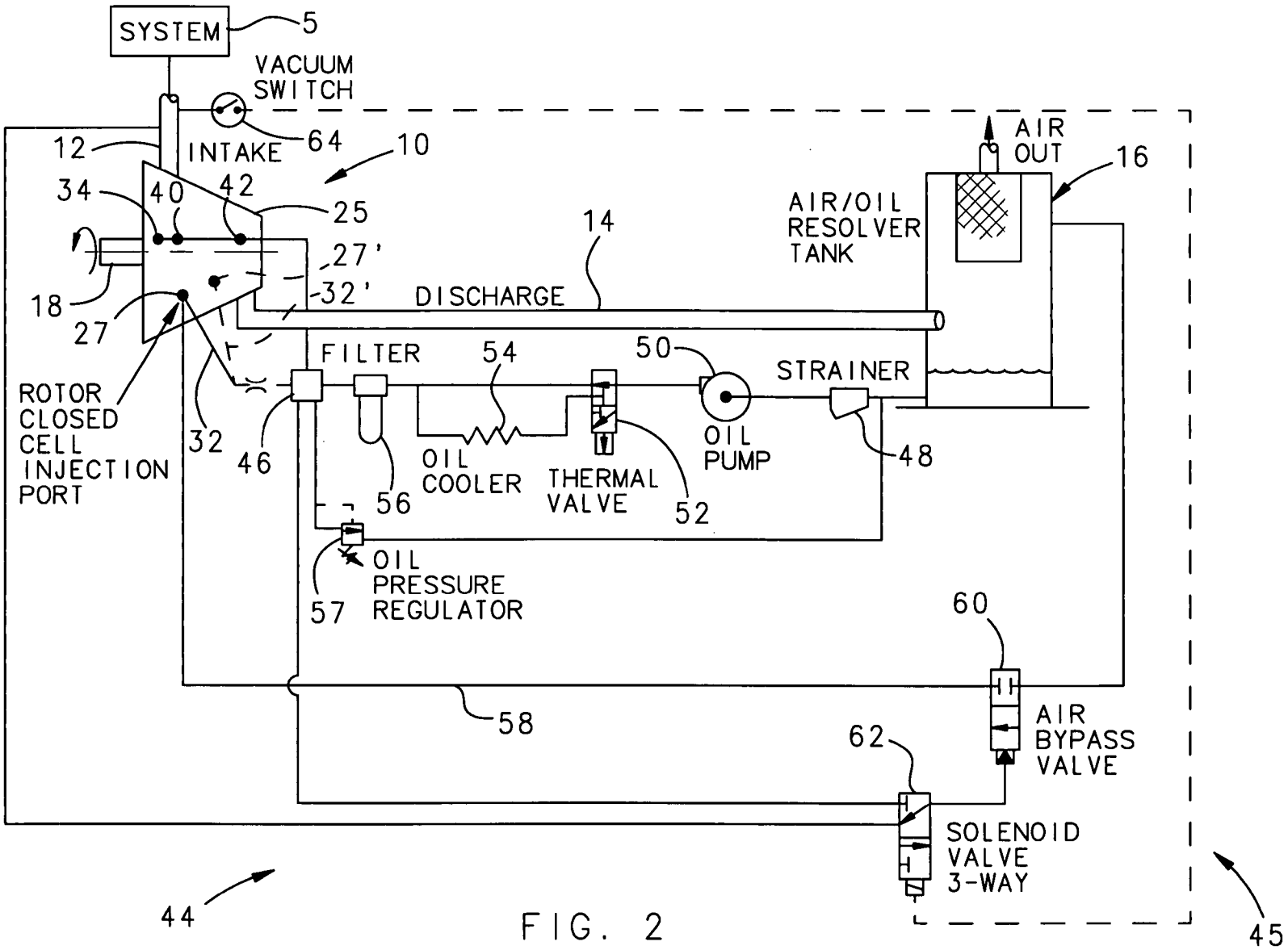
FIG. 2 is a block diagram of a fluid system having a vacuum bypass system for a rotary screw vacuum pump system.

Referring to FIG. 2, a fluid system 44 having a vacuum bypass system 45 for the rotary screw vacuum pump system 10 is illustrated. The fluid reservoir 16 operates as a source for filtered air and lubricant. That is, the fluid reservoir 16 operates as an air-oil lubricant reservoir since both air and lubricant are contained therein. Lubricant is communicated to a manifold 46 through a strainer 48, pump 50, thermal valve 52, heat exchanger 54 and lubricant filter 56 and a pressure regulator 57. From the manifold 46 the lubricant is communicated through the lines 32, 34, 40 and 42 (also illustrated in FIG. 1) to the rotors 26, 28 within the housing 30. After the gas is compressed, air and lubricant is exhausted through discharge line 14 and returned to the reservoir 16.

Figure 3:
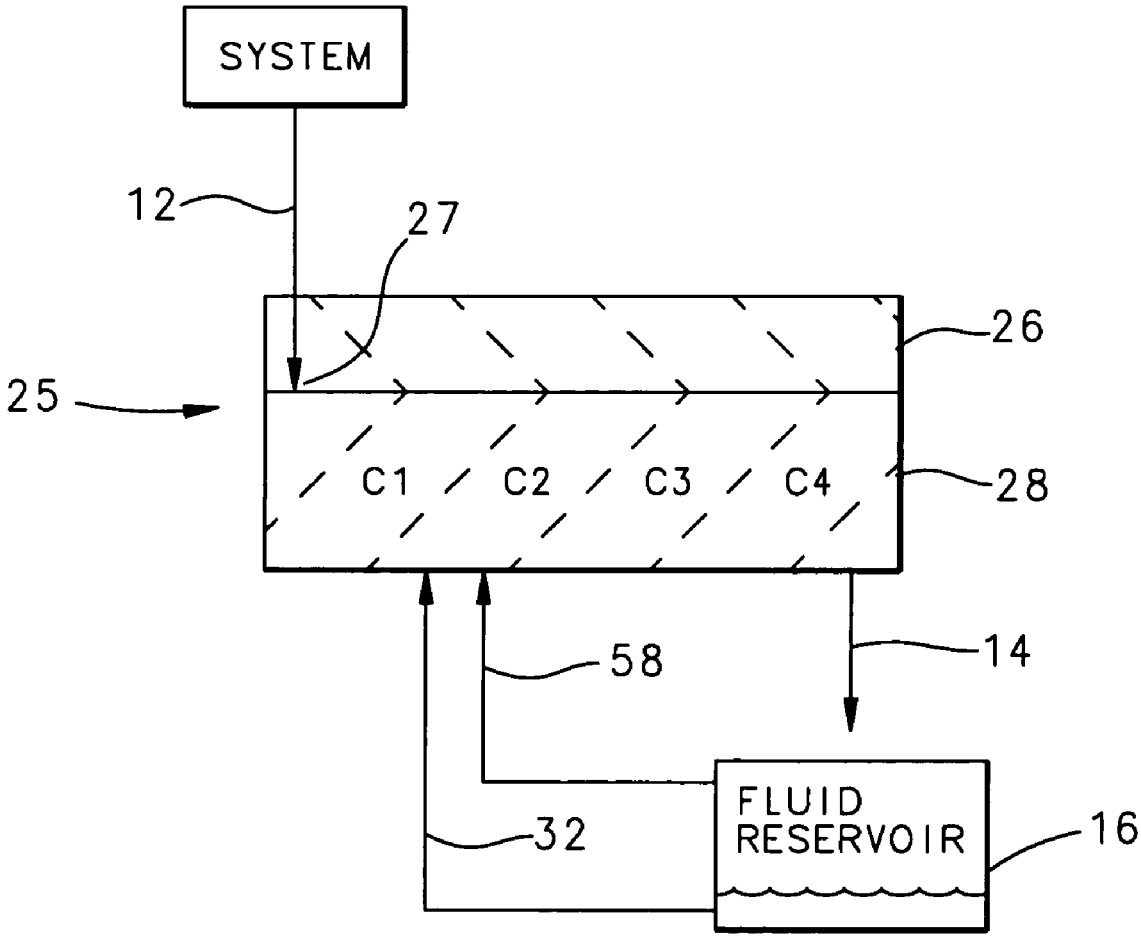
FIG. 3 is a block diagram of a rotary system having a multiple of closed cells.

Preferably, the rotor lubricant conduit 32 communicates with a first closed cell C1 (also schematically illustrated in FIG. 3) just after the port in which the suction conduit 12 communicates with the rotors 26, 28 and compression begins. That is, the lobes of the rotors 26, 28 form "cells" and the first closed cell C1 describes the cell just after the port 27 to the suction conduit 12. Preferably, there are four male rotor lobes, each of which forms compression "cell" C1–C4 (FIG. 3). It should be understood that any number of cells will benefit from the present invention.

The vacuum bypass system 45 includes a bypass air communication conduit 58 selectively communicates air from the reservoir 16 to the rotors 26, 28. Preferably the bypass air communication conduit 58 communicates with the first closed cell C1 (FIG. 3) through the same port through which the rotor lubricant conduit 32 communicates with the rotors 26, 28. Alternatively, a separate port 27' will receive a rotor lubricant conduit 32' adjacent to the port 27. An air bypass valve 60 within the air communication conduit 58 is controlled by a solenoid valve 62, which operates in response to a pressure switch 64 in communication with the vacuum pump suction conduit 12. The pressure switch 64 trips at a vacuum level slightly below the point at which the undesirable cavitation noise generation at terminal vacuum condition begins. Preferably, the pressure switch 64 trips at vacuum levels below 25" Hg.

In operation, the vacuum bypass system 45 eliminates the cavitation noise producing rotor vibration without reducing oil flow and without reducing the vacuum producing capability of the pump 10. At a predetermined pressure, the pressure switch 64 activates the solenoid valve 62 which open the air bypass valve 60. When the air bypass valve 60 is opened, air is selectively introduced into the first closed cell C1 from the reservoir 16 through the air communication conduit 58.

The addition of air from the reservoir 16 into the first closed rotor cell C1 does not reduce the vacuum capability of the pump system 10 as the first closed rotor cell C1 is part of the compression cycle and is not open to the inlet port 27. Also, the vacuum level in the first closed rotor cell C1 is relatively high and draws sufficient air into the cell C1 to minimize rotor torque reversal and the resulting cavitation noise. By introducing the bypass air through the bypass air communication conduit 58 which communicates with the first closed cell C1 through the same or adjacent port through which the rotor lubricant conduit 32 communicates with the first closed cell C1, the lubricant is better atomized, further reducing the unwanted cavitation noise by eliminating slugs of liquid oil being trapped in the compression portion of the rotors 26, 28. Furthermore, the lubricant flow is not reduced and cooling of the vacuum pump system 10 is not compromised.

Figure 4:
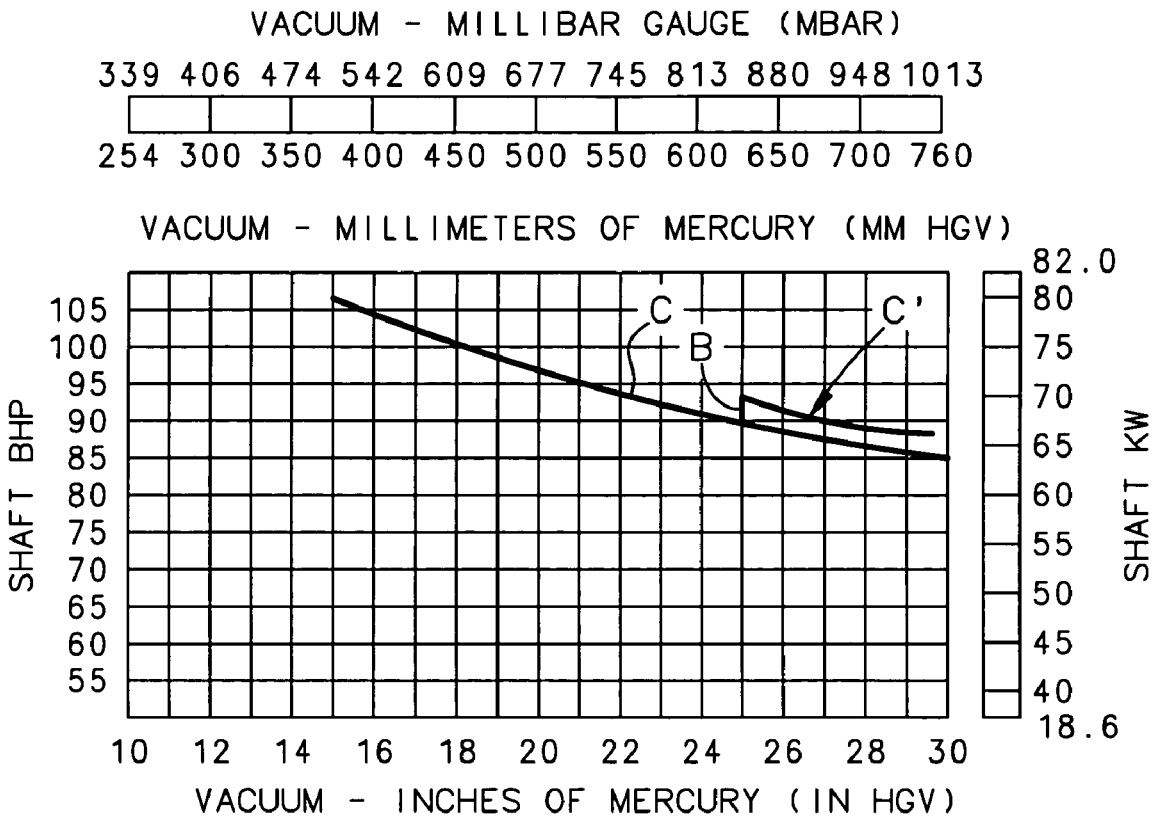
FIG. 4 is a graphical representation of a vacuum and shaft BHP for a rotary screw vacuum pump system.
Figure 5:
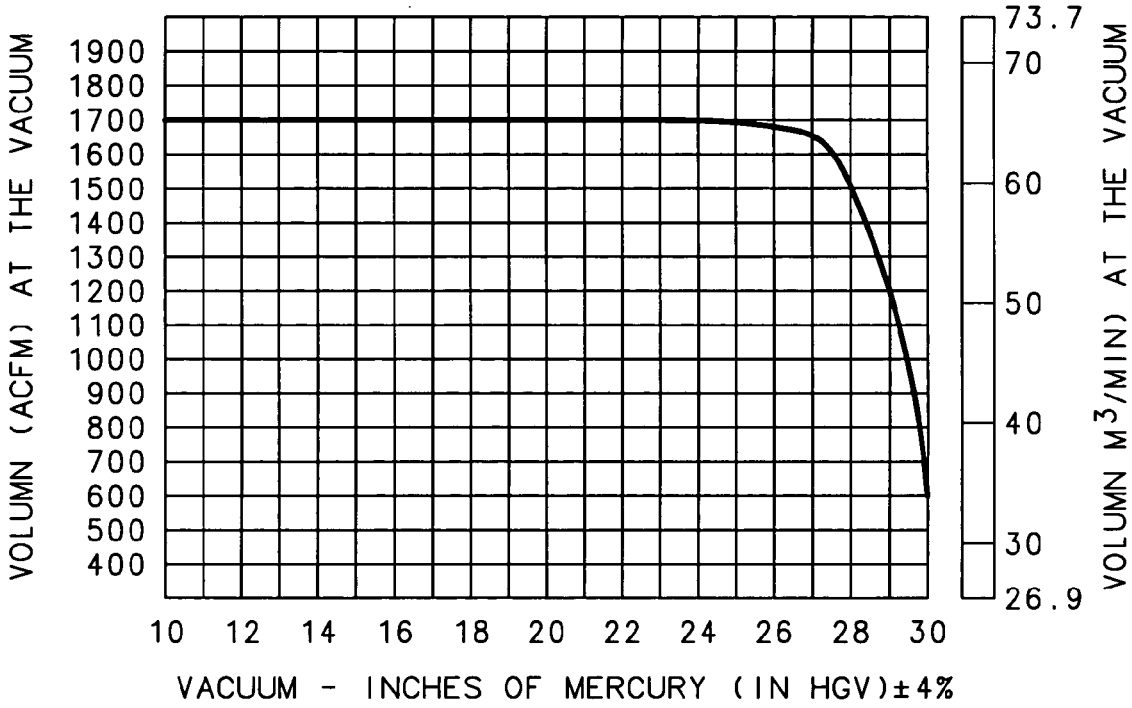
FIG. 5 is a graphical representation of a vacuum and volume for a rotary screw vacuum pump system.

Referring to FIG. 4, an exemplarily power consumption curve C for the vacuum pump system 10 is illustrated. As illustrated, the level of vacuum affects the power consumed. The vacuum levels at which the air bypass valve 60 operates is between 25"–29.5" Hg. This is typically where the undesirable cavitation noise and vibration becomes a problem. Maximum power occurs at 15" Hg-105 bhp. As the system 10 is drawn down to 25" Hg, the power is reduced to 89 bhp. At deeper vacuum levels, for example, 29" Hg, the power goes to 85 bhp. When the air bypass valve 60 opens the bypass air communication conduit 58, the power steps upward at point B and follow the upper portion of the of the power consumption curve C which equates to an increase of 4 bhp at vacuum levels below 25" Hg. This is only a slight increase compared to the 105 bhp capability of the pump system 10, which permits the pump system 10 to operate at vacuum levels below 25" Hg without the undesirable and potentially damaging cavitation noise. The Volume (ACFM) curve (FIG. 5) is not affected by the vacuum bypass system 45, because the bypass occurs inside the first closed rotor cell C1 of the rotors 26, 28 after the suction conduit 12 is closed.

Although particular step sequences are shown, described, and claimed, it should be understood that steps may be performed in any order, separated or combined unless otherwise indicated and will still benefit from the present invention.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A rotary screw vacuum pump system comprising:

a rotor system which defines a plurality of lobes, a suction conduit in communication with said rotor system at a suction port;

a bypass air communication conduit in communication with said rotor system; and an air bypass valve located within said bypass air communication conduit, said air bypass valve operable to selectively open said bypass air communication conduit to said rotor system, said bypass air communication conduit in communication with one of said plurality of lobes downstream of said suction port.

2. The rotary screw vacuum pump system as recited in claim 1, wherein said bypass air communication conduit communicates with a reservoir.

3. The rotary screw vacuum pump system as recited in claim 2, wherein said reservoir is an air-oil reservoir.

4. The rotary screw vacuum pump system as recited in claim 2, wherein said reservoir is a fluid reservoir.

5. The rotary screw vacuum pump system as recited in claim 2, wherein the reservoir is a lubricant reservoir.

6. The rotary screw vacuum pump system as recited in claim 1, wherein said bypass air communication conduit communicates with a first closed cell of said rotor system.

7. The rotary screw vacuum pump system as recited in claim 6, wherein said first closed cell of said rotor system forms a portion of a compression cycle.

8. The rotary screw vacuum pump system as recited in claim 1, wherein said rotor system includes a male rotor and a female rotor in helical mesh at a plurality of lobes.

9. The rotary screw vacuum pump system as recited in claim 1, further comprising a solenoid valve, which selectively operates said air bypass valve.

10. The rotary screw vacuum pump system as recited in claim 9, further comprising a vacuum switch in communication with said solenoid valve and a suction conduit, said solenoid valve selectively operable in response to a suction level at said suction conduit.

11. The rotary screw vacuum pump system as recited in claim 10, wherein said suction level is generally equivalent to a terminal vacuum condition.

12. A rotary screw vacuum pump system comprising:

a rotor system, which includes a male rotor and a female rotor, which forms a plurality of closed cells;

a suction conduit in communication with said rotor system at a suction port;

a bypass air communication conduit in communication with one of said plurality of closed cells located downstream of said suction port; and an air bypass valve located within said bypass air communication conduit, said air bypass valve operable to selectively open said bypass air communication conduit to said rotor system in response to a predetermined suction at said suction conduit said bypass air communication conduit in communication with one of said plurality of lobes downstream of said suction port.

13. The rotary screw vacuum pump system as recited in claim 12, wherein said plurality of closed cells are formed by a plurality of lobes defined by a helical mesh between said male rotor and said female rotor.

14. The rotary screw vacuum pump system as recited in claim 13, wherein said one of said plurality of closed cells is a first closed cell downstream of said suction conduit.

15. A method of decreasing cavitation noise generated by a rotary screw vacuum pump system comprising the step of:

(1) selectively communicating air to a closed cell formed by a rotor system downstream of a suction port in communication with the rotor system in response to a predetermined suction.

16. A method as recited in claim 15, wherein said step (1) further comprises:

forming the closed cell between a male rotor lobe and a female rotor lobe.

17. A method as recited in claim 15, wherein said step (1) further comprises:

selectively communicating the air to the closed cell during a terminal vacuum condition.

18. A method as recited in claim 15, wherein said step (1) further comprises:

selectively communicating the air to the closed cell from an air-oil reservoir.

19. A rotary screw vacuum pump system comprising:

a rotor system, said rotor system includes a male rotor and a female rotor in helical mesh at a plurality of lobes;

a bypass air communication conduit in communication with said rotor system; and an air bypass valve located within said bypass air communication conduit, said air bypass valve operable to selectively open said bypass air communication conduit to said rotor system, said bypass air communication conduit communicates with a first closed cell formed in a first of said plurality of lobes located downstream of a suction conduit, said bypass air communication conduit communicates with said rotor system at a port adjacent a rotor lubricant conduit.

20. A rotary screw vacuum pump system comprising:

a rotor system, said rotor system includes a male rotor and a female rotor in helical mesh at a plurality of lobes;

a bypass air communication conduit in communication with said rotor system; and an air bypass valve located within said bypass air communication conduit, said air bypass valve operable to selectively open said bypass air communication conduit to said rotor system, said bypass air communication conduit communicates with a first closed cell formed in a first of said plurality of lobes located downstream of a suction conduit, said bypass air communication conduit communicates with said rotor system at a port shared by a rotor lubricant conduit.

21. A rotary screw vacuum pump system comprising:

a rotor system;

a bypass air communication conduit in communication with said rotor system;

an air bypass valve located within said bypass air communication conduit, said air bypass valve operable to selectively open said bypass air communication conduit to said rotor system;

a solenoid valve, which selectively operates said air bypass valve;

a vacuum switch in communication with said solenoid valve and a suction conduit, and said solenoid valve selectively operable in response to a suction level generally between 25"–29.5" Hg at said suction conduit.

22. A rotary screw vacuum pump system comprising:

a rotor system, which includes a male rotor and a female rotor, which forms a plurality of closed cells;

a suction conduit in communication with said rotor system at a suction port;

a bypass air communication conduit in communication with one of said plurality of closed cells located downstream of said suction port; and an air bypass valve located within said bypass air communication conduit, said air bypass valve operable to selectively open said bypass air communication conduit to said rotor system in response to a predetermined suction at said suction conduit said bypass air communication conduit communicates with said rotor system at a port shared by a rotor lubricant conduit.

23. A method of decreasing cavitation noise generated by a rotary screw vacuum pump system comprising the step of:

(1) selectively communicating air to a closed cell formed by a rotor system in response to a predetermined suction at a lubrication port within the rotor system.

* * * * *

UNITED STATES PATENT AND TRADEMARK OFFICE

CERTIFICATE OF CORRECTION

PATENT NO. : 7,165,949 B2
APPLICATION NO. : 10/859861
DATED : January 23, 2007
INVENTOR(S) : Mark A. Firnhaber It is certified that error appears in the above-identified patent and that said Letters Patent is hereby corrected as shown below:

On the Title Page:

Assignee's name should read as follows:

(73) Assignee: Sullair Corporation, Michigan, City, IN (US)

Signed and Sealed this

Fifth Day of January, 2010

David J. Kappos

David J. Kappos
*Director of the United States Patent and Trademark Office*